US006536639B1

(12) United States Patent
Frank

(10) Patent No.: US 6,536,639 B1
(45) Date of Patent: Mar. 25, 2003

(54) SKATEBOARD CARRYING STRAP AND METHODS OF MAKING THE SAME

(76) Inventor: Christopher B. Frank, 1337 Quarry Rd., Sparta, MO (US) 65753

( * ) Notice: Subject to any disclaimer, the term of this patent is extended or adjusted under 35 U.S.C. 154(b) by 0 days.

(21) Appl. No.: 09/841,207

(22) Filed: Apr. 24, 2001

(51) Int. Cl.[7] ..... A45F 3/14

(52) U.S. Cl. ..... 224/257; 224/250; 224/251; 224/258; 224/264; 224/600; 224/607

(58) Field of Search ..... 224/257, 264, 224/250, 251, 258, 600, 601, 602, 604, 607

(56) References Cited

U.S. PATENT DOCUMENTS

| | | | | | |
|---|---|---|---|---|---|
| 4,085,872 | A | * | 4/1978 | Foo | 2/250 |
| 4,337,883 | A | | 7/1982 | Pate | |
| 4,790,460 | A | | 12/1988 | Harper, Jr. | |
| 4,911,347 | A | * | 3/1990 | Wilhite | 224/251 |
| 4,984,724 | A | * | 1/1991 | Johnston | 224/257 |
| 5,092,506 | A | | 3/1992 | Bolduc | |
| 5,174,481 | A | * | 12/1992 | LeDune | 224/250 |
| 5,344,056 | A | | 9/1994 | Challoner, et al. | |
| 5,386,593 | A | * | 2/1995 | Kleinman | 2/311 |
| 5,419,475 | A | * | 5/1995 | Naritomi | 2/338 |
| 5,450,991 | A | * | 9/1995 | Neading | 224/250 |
| 5,746,361 | A | | 5/1998 | Johnson | |
| 6,062,448 | A | * | 5/2000 | Balodis | 224/250 |
| 6,131,780 | A | * | 10/2000 | Becker | 224/148.6 |
| 6,332,565 | B1 | * | 12/2001 | Tsai | 224/257 |
| 6,371,346 | B1 | * | 4/2002 | Sharma | 224/195 |

* cited by examiner

*Primary Examiner*—Stephen K. Cronin
*Assistant Examiner*—Maerena W. Brevard
(74) *Attorney, Agent, or Firm*—Richard L. Marsh

(57) ABSTRACT

A carrying strap for carrying a skateboard upon the back of a person attaches around the front truck and behind the back truck of a skateboard. The strap is worn diagonally across the chest of one's body with the skateboard flat side against one's back. The front surface of the strap has rings for attachment of skateboarding paraphernalia. The strap quickly attaches to the skateboard and fits snugly and comfortably against one's back.

15 Claims, 4 Drawing Sheets

SKATEBOARD CARRYING STRAP AND METHODS OF MAKING THE SAME

BACKGROUND OF THE INVENTION

1. Field of the Invention

This invention relates to a carrying strap for a skateboard, a method of making the strap and methods of using the carrying strap for transporting a skateboard while allowing freedom of movement of the appendages of a person carrying the skateboard.

2. Prior Art Statement

It is known to provide a skateboard holder comprising a hanger for removably attaching to a belt passing circumferentially about the waist of a person with one vertical edge of the hanger adapted to be removably positioned under the upper wheels of the skateboard when the skateboard is vertically oriented. For instance, see the U.S. Pat. No. 4,337,883 issued on Jul. 6, 1982, to John R. Pate. It appears that it.would be difficult to walk or ride a bicycle with the skateboard depending downwardly from one's belt using this holder.

It is also known to provide an apparatus which is first attached to a piece of elongate recreational equipment wherein the apparatus with the recreational equipment mounted thereon is then supported over both shoulders and carried against the back of the person carrying the equipment. For instance, see the U.S. Pat. No. 4,790,460 issued on Dec. 13, 1988 to Arthur L. Harper, Jr. or the U.S. Pat. No. 5,092,506 issued on Mar. 3, 1992 to Carmel G. Bolduc or the U.S. Pat. No. 5,746,361 issued on May 5, 1998 to Randall LeRoy Johnson. The carriers described in these patents allow use of ones' appendages while carrying the equipment but it is necessary to first mount and secure the equipment to the apparatus before wearing the apparatus. The additional weight of the carriers described therein makes the assemblage much heavier to lift and wear.

It is further known to provide a carrier case for a recreational board wherein the carrier has a base, a first board engagement means connected to the base, a second board engagement means connected to the base wherein the second board engagement means comprises a pocket for receiving the distal end of the recreational board and at least one support strap connected to the inside of the compartment for receiving the first board engagement end therein when not being used for carrying the recreational board. The recreational board is strapped to the base with transversely affixed securing straps. For instance, see U.S. Pat. No. 5,344,056 issued on Sep. 6, 1994 to Challoner, et al. Though presumably lighter than the aforementioned apparatus of Harper, Bolduc or Johnson, the recreational board must still be affixed to the base before wearing the assembly.

SUMMARY OF THE INVENTION

The equipment carrying apparatus described in the prior art generally has the limitation that the equipment is first affixed to the carrying apparatus and thereafter the apparatus with the equipment mounted thereon is affixed to a person desiring to carry the equipment using a separate securing means. Thus there is a need for a means to transport recreational equipment with a simple carrying strap which does not require the person desiring to carry the equipment to first affix the equipment rigidly to the carrier. Therefore, it is an object of this invention to provide a strap for carrying a skateboard comprising an elongated section of woven webbing material having a first closed loop of material extending from one end and a second closed loop of material extending from an opposite end thereof, the first closed loop spaced from the second closed loop by a central portion, wherein the first closed loop is openable to pass over the width of the skateboard and the front wheel truck mounted on an underside of the skateboard with the second closed loop openable to a dimension at least equal to the width of the skateboard.

It is a significant feature of this invention to provide a strap for carrying a skateboard comprising an elongated section of woven webbing material having a first closed loop of material extending from one end and a second closed loop of material extending from an opposite end thereof, the first closed loop spaced from the second closed loop by a central portion wherein the first loop is engaged with the underside of the skateboard between the front wheel truck and a rear wheel truck and the second loop is engaged with the underside of the skateboard aft of the rear wheel truck when the strap is disposed in a position for carrying over the shoulder of a person desiring to carry the skateboard.

Still another feature of this invention is to provide a strap for carrying a skateboard comprising an elongated section of woven webbing material having a first closed loop of material extending from one end and a second closed loop of material extending from an opposite end thereof, the first closed loop spaced from the second closed loop by a central portion wherein central portion of the elongated section of woven webbing is placed over the shoulder and across the chest of a person using the strap with the first closed loop supporting the skateboard against the back and near the shoulder of the person using the strap and the second closed loop drawing the skateboard against the back and near the waist of the person using the strap.

It is an object of this invention to provide a carrying strap for carrying a skateboard upon the back of a person wherein the carrying strap comprising an elongated section of woven webbing material of a given width wherein each end of the elongated section of woven webbing is folded upon itself, each end joined to the elongated section of woven webbing near each end to form a closed tubular passage across the width adjacent each end, each closed tubular passage having a closed loop of material depending therefrom.

An principal aim of this invention is to provide a strap for carrying a skateboard comprising an elongated section of woven webbing material having a first closed loop of material extending from one end and a second closed loop of material extending from an opposite end thereof, the first closed loop spaced from the second closed loop by a central portion, wherein the first closed loop is a stretchable material and the second closed loop is a stretchable material and wherein the first closed loop of stretchable material closes around the skateboard between the front wheel truck and the rear wheel truck substantially adjacent the front wheel truck thereby firmly holding the skateboard to the strap and the second closed loop of stretchable material closes around the skateboard aft of the rear wheel truck thereby firmly holding the skateboard to the strap and against the body adjacent the waist of the person carrying the skateboard.

Yet another feature of this invention is to provide a carrying strap for carrying a skateboard upon the back of a person which attaches around the front truck and behind the back truck of a skateboard. The strap is adapted to be worn diagonally across the chest of one's body with the skateboard flat side against one's back wherein the strap quickly attaches to the skateboard and fits snugly and comfortably against one's body. The front surface of the strap has rings for attachment of skateboarding paraphernalia.

An object of this invention is to provide a carrying strap having a space between an first piece of material and a second piece of material wherein the space is accessible through at least one opening in the first piece, the second piece or through at least the top marginal end between the first and second piece of woven material.

Still another feature of this invention is to provide a carrying strap for a skateboard wherein the strap has an inside and an outside surface, the outside surface having means for disposing identifying information on at least the outside surface or the inside surface.

Another object of this invention is to provide a cover for a carrying strap for a skateboard wherein the cover is preferably made from a 6.5 oz per square yard, stain resistant launderable cotton/polyester blend fabric of any desired color, texture, decoration or pattern and wherein the ends of the cover each have an elastic closure means associated therewith for closing about the circumference of the carrying strap.

DESCRIPTION OF THE PREFERRED EMBODIMENTS

While the various features of this invention are hereinafter described and illustrated as a carrying strap for a skateboard, it is to be understood that the various features of this invention can be used singly or in various combinations thereof to provide a carrying strap for a skateboard as can hereinafter be appreciated from a reading of the following description.

Figure 1:
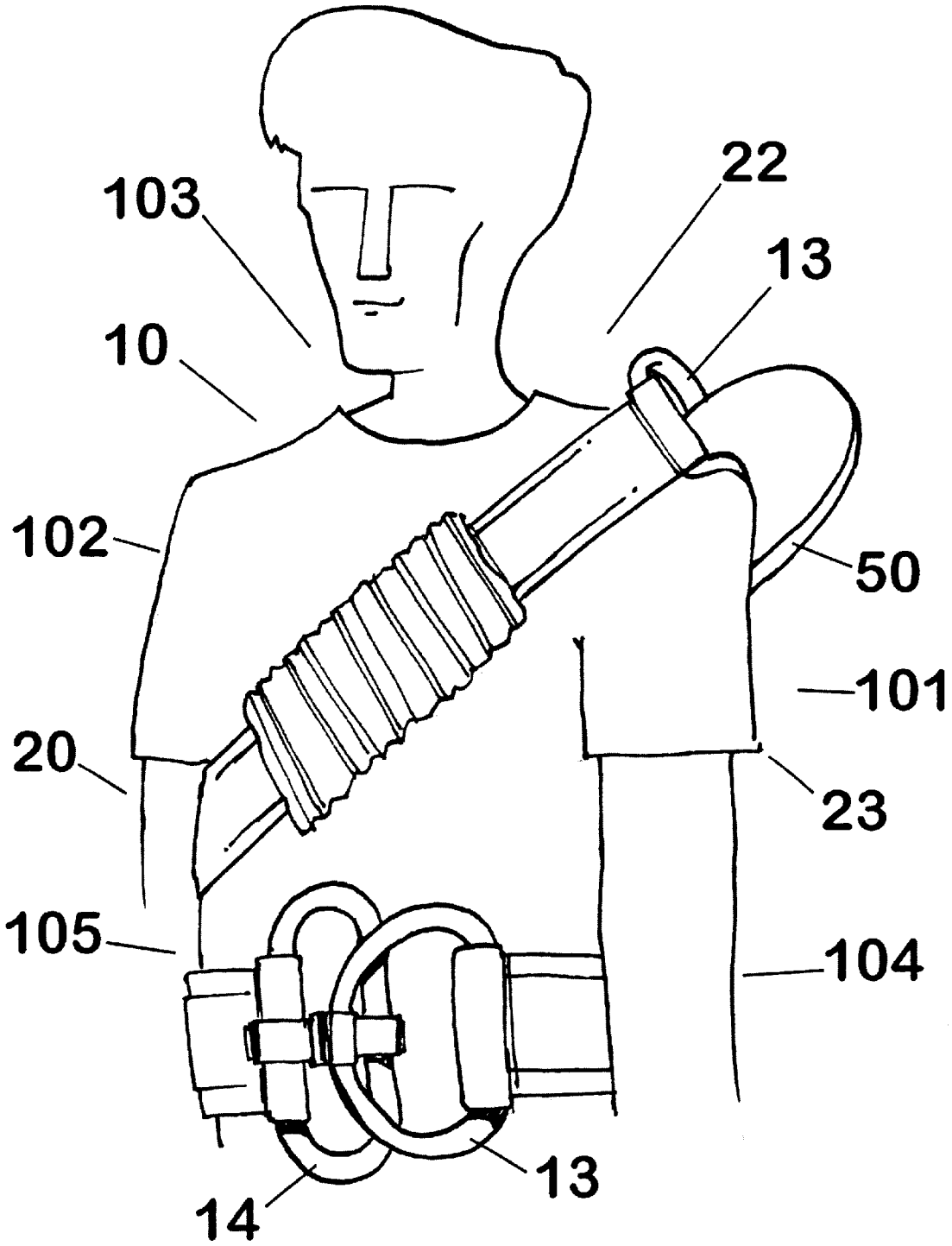
FIG. 1 is a frontal plan view of a person carrying a skateboard with the preferred embodiment of the carrying strap of this invention showing the alternate placement of the carrying strap around the waist of the person when using the skateboard.
Figure 2:
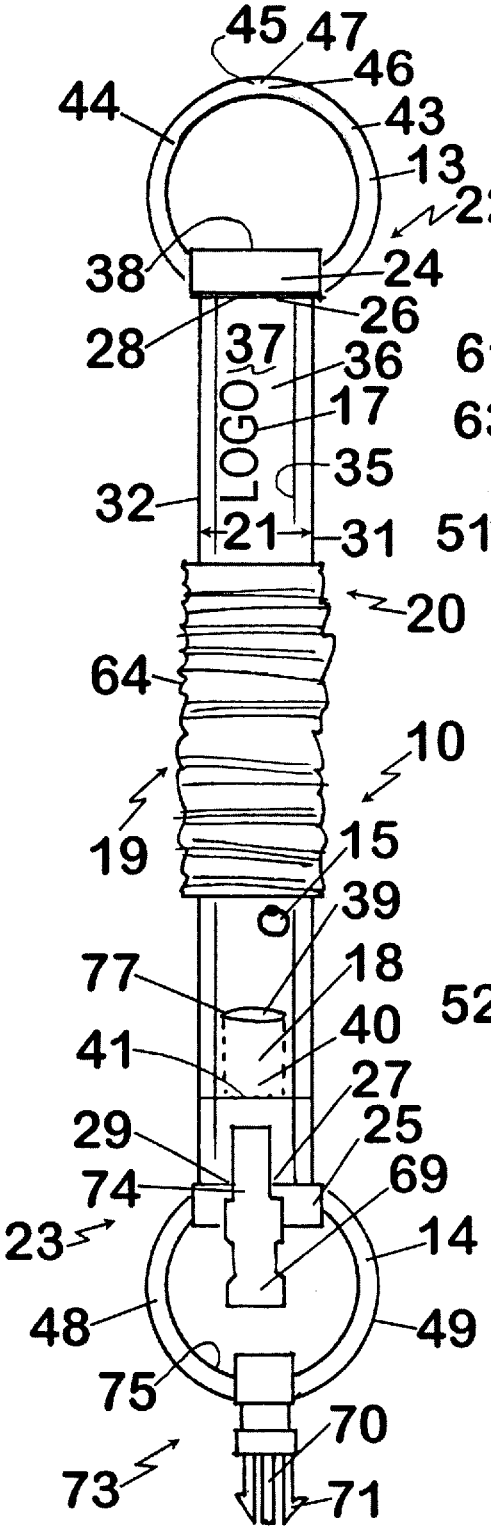
FIG. 2 is a plan view of the preferred embodiment of the carrying strap of FIG. 1.
Figure 3:
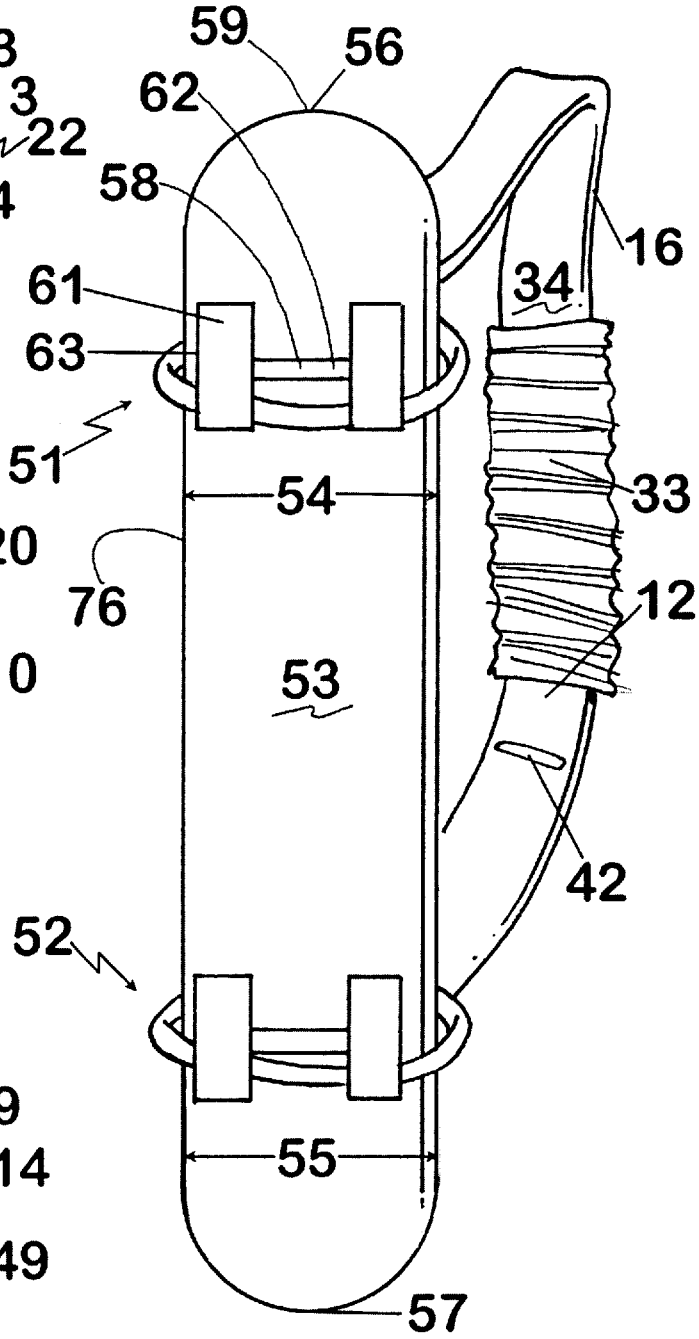
FIG. 3 is a perspective view of the carrying strap of this invention showing the manner of removably affixing the carrying strap to a skateboard.
Figure 4:
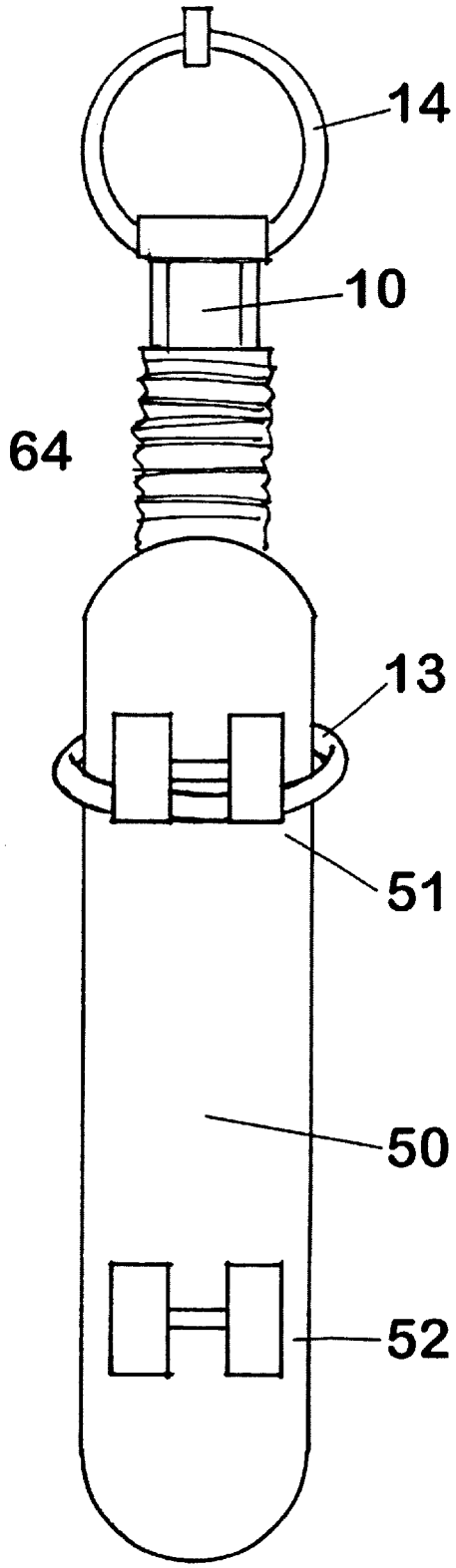
FIG. 4 is a plan view of the strap of this invention shown holding a skateboard in a vertical position from a wall mount.

Referring now to FIGS. 1–3, the carrying strap of this invention for carrying a skateboard 50 upon the back of a person is generally shown by the numeral 10. Strap 10 comprises an elongated section 20 of woven webbing material having a first closed loop of material 13 extending from one end 22 and a second closed loop of material 14 extending from an opposite end 23 thereof wherein first closed loop 13 is spaced from second closed loop 14 by a central portion 19. First closed loop 13 is openable to pass over the width of skateboard 50 and at least one wheel of the front wheel truck 51 mounted on an underside 53 of skateboard 50 and second closed loop 14 is openable to a dimension at least equal to the width of skateboard 50. Preferably, first loop 13 is engaged with underside 53 of skateboard 50 between front wheel truck 51 and a rear wheel truck 52 and second loop 14 is engaged with underside 53 aft of rear wheel truck 52 when strap 10 is disposed in a position for carrying skateboard 50 over the shoulder 103 of one's body 105 desiring to carry skateboard 50. Central portion 19 of elongated section 20 of woven webbing is placed over shoulder 103 and across the chest 102 of one's body 105 using strap 10 with first closed loop 13 supporting skateboard 50 against the back 101 near shoulder 103 as second closed loop 14 draws skateboard 50 against back 101 and near the waist 104 of one's body 105. Thus skateboard 50 is releasably held against back 101 of one's body 105 whereby one may readily walk or operate a bicycle, motorcycle or scooter without constant attention to skateboard 50 or carrying strap 10.

Preferably, first closed loop 13 of strap 10 is a stretchable material such that first closed loop 13 retracts upon release from being expanded over the leading nose 56 and over front wheel truck 51 and closes around skateboard 50 between front wheel truck 51 and rear wheel truck 52 in a position substantially adjacent front wheel truck 51. Strap 10 is thereby releasably affixed to skateboard 50 such that first closed loop 13 must again be expanded over wheel truck 51 in order to remove first closed loop 13 from engagement with skateboard 50. It is also preferred that second closed loop 14 is also a stretchable material such that second closed loop 14 also retracts upon release from being expanded over trailing end 57 and closes around skateboard 50 aft of rear wheel truck 52 thereby firmly holding skateboard 50 to strap 10 and against body 105 adjacent waist. 104 of one's body 105. Thus, the inside length of closed loops 13 is less than the circumference of skateboard 50 at the position just aft of rear wheel truck 52 while the inside length of first closed loop 13 may be from about the circumference of skateboard 50 aft of front wheel truck 51 to slightly less than the circumference from mount 58 of front wheel truck 51 around nose 56. Skateboard 50 is approximately 8 inches wide immediately aft of front wheel truck 51 and relatively thin in comparison to its width with nose 56 comprising one half of an ellipse with a major axis length of 20 inches, nose 56 having a point 59 spaced from mount 58 of front wheel truck 51 about 4 inches. Furthermore, front wheel truck 51 comprises mount 58 having a pair of wheels 61 mounted on an axle 62 wherein the distance from one outside edge 63 of one wheel 61 is about 4 inches from mount 58. Thus as the circumference behind mount 58 and over one wheel is about 13 inches, it is preferred that the free length of first closed loop 13 be about 13 inches to readily pass over one wheel and behind mount 58 though first closed loop 13 may be up to about 24 inches to accommodate skateboards of different widths and/or wheel truck configurations. Though first loop 13 may close fully about skateboard 50 thus binding skateboard 50 to strap 10, first loop 13 is preferably slightly loose around skateboard 50 aft of front wheel truck 51 to permit easy removal of strap 10 from over wheel truck 51. Immediately aft of rear wheel truck 52, skateboard 50 is approximately 7.5 inches wide and therefore second closed loop 14 is preferably less than about 15 inches and most preferably about 14 inches to snugly capture skateboard 50 on strap 10 and thus binding strap 10 to skateboard 50. As loops 13, 14 are of stretchable material, closure of loops 13, 14 about skateboard 50 assists in keeping skateboard 50 against back 101 of one's body 105. Preferably strap 10 is of fixed length between one end 22 and opposite end 23 though strap 10 may be adjusted along the length thereof to accommodate the particular person using strap 10 by folding over a portion of at least one of ends 22, 23 and affixing the folded over portion to central portion 19. Likewise, central portion 19 may have a separate adjustment means associated therewith such as a buckle and tongue as is well known in the art.

Referring now specifically to FIG. 2, carrying strap 10 comprises an elongated section 20 of woven webbing material of a given width 21 wherein top end 22 of elongated section 20 is folded upon itself having terminal end 28 joined to elongated section 20 at juncture 26 near top end 22 to form a closed tubular passage 24 across width 21 adjacent top end 22. In like manner bottom end 23 of elongated section 20 is folded upon itself having its terminal end 29 joined to elongated section 20 at juncture 27 near bottom end 23 to form a closed tubular passage 25 across width 21 adjacent bottom end 23 In the preferred embodiment, strap 10 comprises a padded luggage strap having buckles removed from the ends thereof and thereafter having tubular passages 24, 25 formed at ends 22, 23 with first and second loops 13, 14 disposed in tubular passages 24,25 respectively. The padded luggage strap already has padding 60 affixed thereto along marginal edges 31, 32 at a seam 35 and thus strap 10 is readily constructed from the luggage strap.

It is fully understood that in the instant invention, each closed tubular passage 24, 25 has a closed loop of material 13, 14 respectively, depending therefrom. In the preferred embodiment, a closed loop of stretchable material similar to tie-down cords having a polymeric core with a protective stretchable sheath, is first laid across each end 22, 23 spaced slightly inwardly from terminal ends 28, 29 respectively wherein terminal ends 28, 29 are then folded over the closed loop of stretchable material and firmly affixed to central section 19 at junctures 26, 27 respectively. Thus, closed loops 13, 14 are established at each end 22, 23 of carrying strap 10. Closed loop 13, 14 of stretchable material may be made by the manner described above by placing the open ends of separate cut lengths of stretchable material in butted relationship adjacent each of terminal ends 28,29 and rolling terminal ends 28, 29 thereover and thereafter affixing both terminal ends 28, 29 and the cut lengths of stretchable material to central section 19 at junctures 26, 27 respectively thus creating closed loops 13 and 14 at top end 22 and bottom end 23 respectively. By adjusting the length of open ended sections of stretchable material, the manufacturer may provide for different amounts of binding tension about a skateboard of a specified width, a given binding tension to skateboards of different widths or differing amounts of binding tension about skateboards of different widths. Closed loops 13, 14 may be separately made prior to disposing in tubular passages 24, 25 by joining the ends of a length of stretchable material in a manner well known in the art. One method of joining the ends of a length of stretchable material comprises overlapping the open ends and crimping a metallic clip around the overlapped portions.

Referring also to FIG. 3, elongated section 20 of carrying strap 10 has an inside surface 12 and an outside surface 11, inside surface 12 adapted to be placed against the chest 102 and over the shoulder 103 of the person carrying skateboard 50. Width 21 of elongated section 20 is sufficiently broad to provide for comfortable wear over shoulder 103 and to provide for at least one identifying marking 17 on outside surface 11 as well as pockets 18 thereon for storage of various items as desired by the person using strap 10, all as will be hereinafter described. For instance, one identifying marking 17 may comprise a logo for the marketing or manufacturing concern providing strap 10 to the market but may also be used for individualizing each strap 10. Identifying marking 17 may be made integral with elongated section 20 of woven webbing material at the point of manufacture of thereof, affixed at manufacture of strap 10, applied at a point of sale and/or applied by the user/owner of strap 10 after purchase. Thus, identifying marking 17 may comprise a coat of arms, a team symbol, an individual's name or a combination thereof Additionally, outside surface 11 may have attaching rings 15 depending therefrom for clipping articles thereto such as key rings, pagers or the like. Though identifying marking 17 and attaching ring 15 are shown on outside surface 11, identifying markings 17 and/or attaching rings 15 may also be applied to inside surface 12 for substantially the same purpose.

Preferably, however, inside surface 12 has a shoulder portion 16 near top end 22 for a comfortable fit over shoulder 103 wherein carrying strap 10 has a padding 60 associated with inside surface 12 at shoulder portion 16 or all along inside surface 12 through out central section 19 of elongated section 20. Padding 60 may be a separate material telescopically received over strap 10 and movable along central section 19 or may be affixed to inside surface 12 by means well known in the art. In the preferred embodiment, strap 10 comprises a length of woven material approximately 3 inches in width with padding 60 firmly affixed to inside surface 12 substantially the entire length between junctures 26 and 27. Preferably, padding 60 is attached to the woven material along marginal edges 31, 32 at seam 35 and also across the ends thereof at junctures 26, 27.

Figure 5:
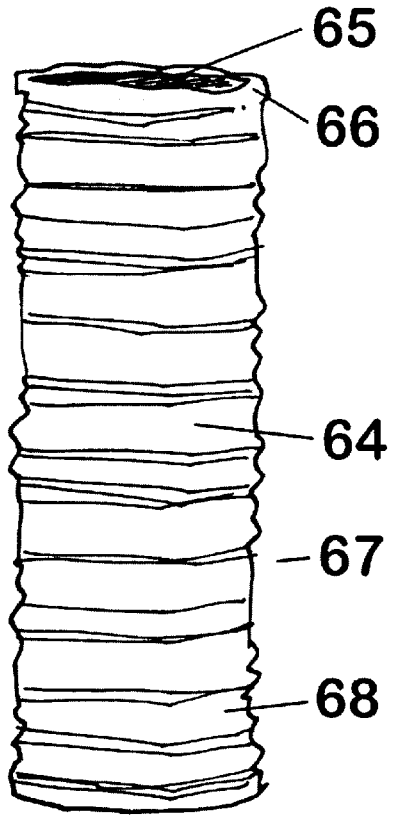
FIG. 5 is a partial perspective view of a cover for the strap of this invention showing gathered, openable ends.
Figure 6:
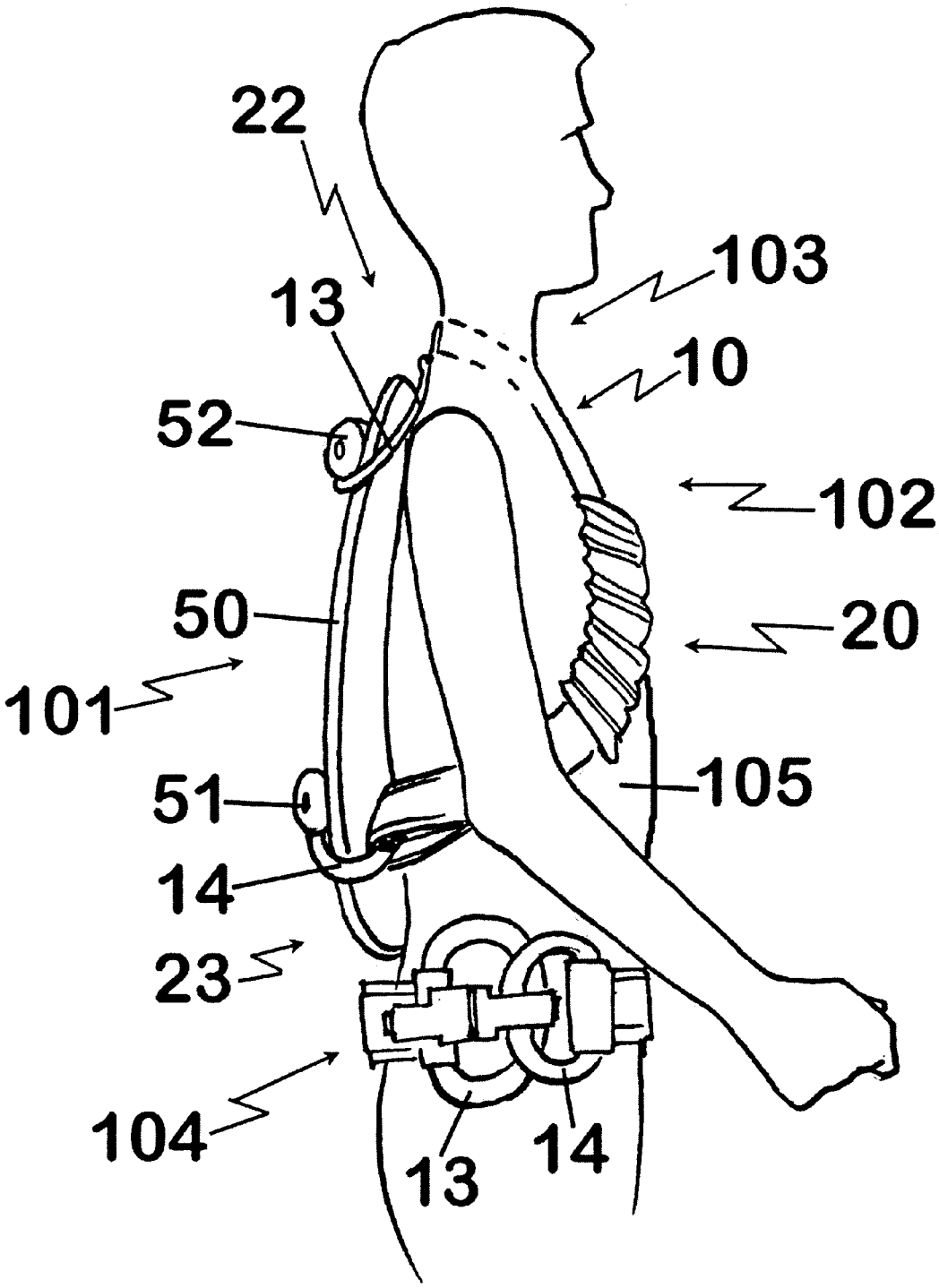
FIG. 6 is a side plan view of a person carrying a skateboard with the preferred embodiment of the carrying strap of this invention showing the alternate placement of the carrying strap around the waist of the person when using the skateboard.

A protective cover 64 is also preferably provided with strap 10, cover 64 telescopically received over strap 10. Referring to FIG. 5, cover 64 is preferably an elongated tube 67 of light fabric material having the ends gathered and fitted with an elastic closure. End 65 is provided with an elastic closure 66 wherein elastic closure 66 is firmly affixed to one surface of elongated tube 67. Elastic closure 66 is affixed to end 65 when elastic closure 66 is elongated to the length of end 65 and when released to resume its original unstretched length, elastic closure 66 gathers end 65 into a retracted condition such that the overall circumference of end 65 is less than the overall circumference of the body 68 of elongated tube 67 and also preferably less than twice the width of strap 10. Therefore, one end 65 of cover 64 may be stretched to fit over one end 22, 23 of strap 10 and thereafter strap 10 may be telescopically received within cover 64 wherein the ends 65 of cover 64 are adapted to encircle and close around strap 10. As ends 65 are gathered and have elastic closure 66 therein, ends 65 retract in circumference to removably attach cover 64 to strap 10. As cover 64 is provided separate from strap 10, cover 64 may be a decorative material having a specific pattern thereon or may be individualized by the person receiving cover 64. For instance, identifying marking 17 may also be provided on cover 64 wherein identifying marking 17 may comprise any of the above mentioned components. Additionally, cover 64 may be used to indicate a level of proficiency in the art of skateboarding similar to the proficiency level indicated by the various colored belts in the martial arts fields. In fact, a series of designs for cover 64 may be devised to be awarded to participants in the various skateboard competitions. As cover 64 is made from a light fabric material cover 64 may readily be removed from strap 10 and laundered to remove any soiling from cover 64. Cover 64 thus protects strap 10 from becoming soiled when transporting or storing strap 10. In addition to providing soiling protection to strap 10, cover 64 is also useful to further retain items stored in pockets 18 or carried on rings 15 as elastic closures 66 fit snugly around strap 10 closing against surfaces 34, 35. Protective cover 64 may easily be moved along strap 10 to expose at least one of rings 15 or pockets 18 for retrieval or placement of an object thereon or therein and thereafter slipped over the previously exposed ring 15 or pocket 18 to again provide for the additional protection.

Though, as shown in FIGS. 1–6, preferred cover 64 is larger in circumference than strap 10 wherein gathered ends 65 are adapted to close about strap 10 to snugly hold cover 64 thereon, cover 64 may be made substantially the same size as strap 10 and be telescopically received thereon to simulate a skin like covering for strap 10. Where cover 64 is so made, the length of cover 64 between ends 65 is substantially the same length as the distance between closed tubular passages 24, 25 and has an inside circumference substantially equal to twice the width of strap 10. Thus, cover 64 may appear to be a skin over strap 10 and may have an exterior appearance of a skin such as that of a reptile, though other skin like materials may be used to advantage as well as may appeal to particular skateboarders. Furthermore, a tightly fitting cover 64 made to substantially the same size as strap 10 may be made in different colors, color combinations, designs and/or with team insignia provided thereon as desired by individual skateboarders or teams thereof.

Strap 10 is also preferably provided with a buckle pair 69, 70, buckle 69 comprising a female socket 72 in one end thereof for receiving a male locking device 73 of male buckle 70. Male locking device 73 generally comprises a pair of ears 71 which are adapted to lockingly engage with a mating pair of holes in the side edges of female buckle 69. Ears 71 may be pinched together to disengage same from female buckle 69 wherein the buckle pair 69, 70 may thereafter be separated. Buckle pair 69, 70 is useful in affixing strap 10 about the waist of one's body 105 when using skateboard 50 in the art of skateboarding. Thus it is not necessary to have a separate location for storage of strap 10 when practicing the art though of course, strap 10 may be affixed to an object separate from the person using skateboard 50 by hanging strap 10 from a tree branch, fence post, garment book or the like using one of closed loops 13, 14 for placing over the object. Buckle pair 69, 70 is readily available on the market and can be affixed to strap 10 as shown in FIG. 2 where female buckle 69 is affixed to one end 23 using a short buckle strap 74 and male buckle 70 is affixed to loop 14 on end 23. When strap 10 is wrapped around the waist 104 of a one's body 105, loop 14 having male buckle 70 affixed thereto is passed through loop 13 and double back upon itself to be releasingly coupled with female buckle 69 affixed to end 23. Though shown on end 23 of strap 10, buckle pair 69, 70 may be affixed to end 22 or may be split between ends 22, 23 wherein one buckle 69 is affixed to end 22 and the other buckle 70 is affixed to end 23.

When it is desired to transport skateboard 50, skateboard 50 is held in one hand and loop 13 is placed over nose 56 and one wheel 61 of front truck 51 placing the inside 75 of loop 13 against mount 58. Thereafter, loop 13 is placed over other wheel 61 on front wheel truck 51 with inside 75 of loop 13 now riding against mount 58 behind wheel truck 51. Strap 10 thus extends away from skateboard 50, skateboard 50 suspended from loop 13. Skateboard 50 is then hoisted over shoulder 103 placing the riding surface 76 against back 101 with inside surface 12 of strap 10 passing over shoulder 103 and lying substantially across chest 102, skateboard 50 and strap 10 temporarily held in position by one hand. Trailing end 57 of skateboard 50 is then grasped with the other hand and loop 14 is then stretched over trailing end 57 of skateboard 50 sliding loop 14 adjacent rear wheel truck 52. As loop 14 is stretched over trailing end 57, loop 14 firmly holds skateboard 50 to strap 10 thus providing transporting safety to one transporting same. Skateboard 50 is supported by loop 13 behind front wheel truck 51 and held against body 105 by binding loop 14 to skateboard 50 aft of rear wheel truck 52. It is not necessary to first rigidly affix skateboard 50 to a carrier as in the prior art and thereafter affix the carrier to one's body in order to transport skateboard 50 as it is now possible with strap 10 of this invention to easily wear skateboard 50 upon one's back by merely placing one loop 13 over nose end 56, over front wheel truck 51 and thereafter bind skateboard 50 to back 101 by slipping loop 14 over trailing end 57. If previously telescopically received over strap 10, protective cover 64 may be extended to cover strap 10 from one end 22 to other end 23 after strap 10 is placed over one's shoulder and against back 101.

In one alternate embodiment, inside surface 12 and outside surface 11 are disposed on separate pieces of woven material, a first piece 33 of woven material having inside surface 12 on one side 34 thereof and a second piece 36 of woven material having outside surface 11 on one side 37 thereof wherein a second side of first piece 33 of woven material is disposed in facing relationship to a second side of second piece 36, first piece 33 affixed to second piece 36 along the marginal edges 31, 32 thereof at seam 35 establishing a space 30 between first piece 33 and second piece 36. Space 30 is therefore available for a multitude of purposes and preferably has padding 60 disposed therein in at least a portion of the volume of space 30. Also, padding 60 in space 30 is disposed at least at shoulder portion 16 thus adding to the comfort provided by the wide expanse of strap 10 at shoulder portion 16. As first piece 33 and second piece 36 are affixed along marginal edges 31, 32, an opening 38 is created at top end 22 wherein space 30 is accessible through opening 38 between first piece 33 and second piece 36. Thus, padding 60 may be inserted through opening 38 into space 30 disposing padding 60 at shoulder portion 16. Padding 60 may be retained at shoulder portion 16 in a suitable manner as is well known in the art though padding 60 in space 30 may extend throughout the volume thereof Space 30 may also have pockets disposed therein as it is also within the scope of this invention to provide at least one opening 39 through outside surface 11, and in the preferred embodiment through second piece 36 of woven material and therefore into space 30, opening 39 opening into a pocket 18. In the preferred embodiment, pocket 18 within space 30 is created by closing off a portion 40 of space 30 by affixing first piece 33 to second piece 36 at closure 41. Similar pockets 18 may be disposed along the length of central portion 19 of elongated section 20 by disposing additional openings 39 at selected places along the length of central portion 19 and affixing first piece 33 to second piece 36 at additional closures 41. By so providing openings 39 through outside surface 11, space 30 is accessible through openings 39. Though pockets 18 are preferably disposed through outside surface 11, it is also possible to make pockets 18 accessible through openings 42 through inside surface 12 and, in the preferred embodiment, these openings 42 are disposed through first piece 33 of woven material.

In another alternate embodiment, strap 10 comprises pieces 33, 36 of woven material affixed together at the terminal ends thereof thus creating top end 22 and bottom end 23 wherein closed tubular passages 24, 25 are established by affixing pieces 33, 36 together at junctures 26, 27 near top end 22 and bottom end 23. Each closed tubular passage 24, 25 has a loop 13, 14 of material, respectively, extending from the open ends thereof for removably attaching skateboard 150 thereto. As in the preferred embodiment, padding 60 may be inserted into space 30 created between pieces 33, 36 prior to closing one of ends 22, 23, however, since top and bottom ends 22, 23 are already affixed together and tubular passages 24, 25 established, padding 60 may be inserted into space 30 through one of the marginal edges 31, 32 prior to closing that marginal edge. In a manner like that in the preferred embodiment, pockets 18 may be created in strap 10 by affixing pieces 33, 36 together at junctures 41 and providing openings 39 into portions 40 thus established. Of course, marginal edges 31, 32 may be left open though padding 60 would need to be separately applied to strap 10. Yet alternately, pockets 18 may then be disposed directly upon any accessible surface by affixing a previously manufactured pocket directly to the desired surface leaving the opening of the previously manufactured pocket exposed for access thereto.

Strap 10 having loops 13, 14 on ends 22, 23 respectively may also be used to display skateboard 50 upon a wall or from a hook at a given location by first placing loop 13 over nose end 56, then over wheel truck 51 and thereafter placing loop 14 over the hook. Skateboard 50 is thus suspended from the hook wherein skateboard 50 is supported by strap 10. As strap 10 is suspended with outside surface 11 facing outwardly, identifying marking 17 may be used to identify various skateboards 50 suspended from a multiple of hooks. In addition, a particular cover 64 won in a competition may first be placed over one strap 10 and thereafter skateboard 10 hung from a hook to indicate to observers the proficiency of the skateboarder. Though only one cover 64 is generally adapted for use on one strap 10, it is entirely possible to place a series of covers 64 in sequential relationship upon a single strap 10 to indicate a progression through the proficiencies in the art of skateboarding or to provide for individualized covers over particular pockets 18 or rings 15. Thus, the reader of the instant specification can appreciate the multitude of uses of cover 64 for skateboard strap 10.

In the method of making strap 10 for carrying skateboard 50, strap 10 comprises elongated section 20 of woven webbing material such as a 2 pound per square yard nylon duck approximately 3 inches wide. It has been found that a strip of woven duck approximately 3 feet in length is quite suitable for strap 10. Terminal ends 28, 29 are preferably flame burnished to prevent unraveling. First closed loop 13 is preferably formed from a length of stretchable material such as used for tie-down cords having a polymeric core and a stretchable sheath, these tie-down cords also commonly known as Bungee Cords manufactured by the Bungee Corporation, 429 West Laurel Street, Scottsboro, Ala. 35768. Loop 13 is preferably a ⅜ inch diameter bungee cord approximately 22 inches in length with the ends overlapped and joined together with a binding clip to provide a loop of bungee cord approximately 18 inches inside circumference. Loop 13 then is placed adjacent terminal end 28 with terminal end 28 extending around the circumference of the bungee cord in one place wherein terminal end 28 is firmly affixed to central section 19 at juncture 26 preferably by sewing terminal end 28 to central section 19. By passing end 28 about the bungee cord and affixing end 28 to central section 19, tubular passage 24 is formed on end 22 having loop 13 affixed therein. Tubular passage 25 is formed on end 23 in the same way with a loop of bungee cord captured therein, however loop 14 on end 23 is preferably shorter in inside circumference and is preferably about 17 inches in free length and joined into loop 14 about 13 inches inside circumference. Thus, loop 13 extends from one end 22 of strap 10 and in like manner second closed loop 14 extends from opposite end 23 thereof First closed loop 13 is spaced from second closed loop 14 by central portion 19 wherein first closed loop 13 is openable to pass over one wheel 61, around mount 58 and over other wheel 61 of front wheel truck 51 mounted on underside 53 of skateboard 50. Second closed loop is openable to a dimension at least equal to the width 55 of skateboard aft of rear wheel truck 52 thereby providing binding tension around skateboard 50 when second closed loop 14 is stretched over trailing end 57. Padding 60 is applied to inside surface 12 of strap 10 and affixed thereto by sewing along marginal edges 31, 32 at seam 35. Padding 60 is also preferably sewn to strap 10 at junctures 26, 27 thus closing the ends of padding 60. In the preferred embodiment, strap 10 comprises a padded luggage strap having buckles removed from the ends thereof and thereafter having tubular passages 24, 25 formed at ends 22, 23 with first and second loops 13, 14 disposed in tubular passages 24, 25 respectively. The padded luggage strap already has padding 60 affixed thereto along marginal edges 31, 32 at a seam 35 and thus strap 10 is readily constructed from the luggage strap. Buckles 69, 70 are thereafter affixed to strap 10 by sewing a short length of strapping material having buckle 69 thereon to terminal end 23 having buckle 69 extend from end 23 into loop 14 and buckle 70 is affixed around loop 14 by sewing the end of a short length of strapping material having buckle 70 thereon to itself such that the short length of strapping material is slidable around loop 14. Buckles 69, 70 may be the same buckles removed from the aforementioned luggage strap but may also be smaller buckles purchased separately.

In an alternate method, strap 10 is formed by the steps of weaving elongated section 20 of 2# per square yard nylon duck material approximately 3 inches in width to a length of about 3 feet, dividing one end 23 into two separate portions 43, 44, weaving terminal ends 45, 46 of one end 22 together at juncture 47 into first closed loop 13, dividing opposite end 23 into two separate portions 47, 48 and weaving the terminal ends of opposite end 23 into second closed loop 14. Padding 60 is then sewn to inside surface 12 at seam 35 along both marginal edges 31, 32 from the point at which separate portions 43, 44 are joined to a point at which separate portions 47, 48 are joined. Thereafter, buckles 69, 70 are affixed to end 14 as hereinbefore described. In this embodiment, closed loops 13, 14 may not be made of stretchable material, however, strap 10 made thereby is still functional as a carrying strap for skateboard 50 as loop 13 is adapted to pass over one wheel 61, be placed adjacent mount 58 and thereafter placed over other wheel 61 to support skateboard 50 upon back 101 of one's body 105. Closed loop 14 does not firmly bind skateboard 50 against back 101, however, it has been shown by the inventor hereof that closed loop 14 need not bind firmly about skateboard 50 in order to hold same in position against back 101 as strap 10 supports skateboard 50 over shoulder 103 and loop 14 is functional in holding skateboard 50 against back 101.

In an alternate embodiment described above wherein inside surface 12 and outside surface 11 are disposed on separate pieces of woven material, the method of making comprises weaving first piece 33 of 2 pound per square yard nylon duck having inside surface 12 on one side 34 thereof and weaving second piece 36 of 2 pound per square yard nylon duck having outside surface 11 on one side 37 thereof The second side of first piece 33 is then disposed in face to face relationship to a second side of second piece 36 wherein first piece 33 is affixed to second piece 36 along marginal edges 31, 32 thereof at seam 35 establishing a space 30 between first piece 33 and second piece 36. Space 30 has padding 60 disposed therein in at least a portion of the volume of space 30 and especially at least at shoulder portion 16 thus adding to the comfort provided by the wide expanse of strap 10 at shoulder portion 16. As first piece 33 and second piece 36 are affixed along marginal edges 31, 32, opening 38 is available at top end 22. Thus, padding 60 is inserted through opening 38 into space 30 disposing padding 60 at shoulder portion 16. Padding 60 is retained at shoulder portion 16 by sewing through first and second pieces 33, 36 though padding 60 in space 30 may also extend throughout the volume of space 30 and be affixed therein by sewing along the length of first and second pieces 33, 36 or across first and second pieces 33, 36 at at least one location.

When pockets 18 are provided in space 30, at least one opening 39 may be cut through outside surface 11 in second piece 36 thereby providing access to space 30 through opening 39. Where opening 39 is provided, a closure means 77 is associated therewith, closure means 77 selected from the group comprising buttons, zippers, snaps, hook & loop fasteners, mutually engaging tongue & grooves, bendable mating springs or combinations thereof Alternately, at least one pocket 18 may be affixed to outside surface 11 or inside surface 12 by sewing a pocket 18 to the respective surface 11, 12. Carrying strap 10 may have multiple openings through second piece 36 wherein each opening 39 has closure means 77 associated therewith wherein each opening 39 opens into a separate compartment 40 disposed between first piece 33 and second piece 36, compartments 40 formed by sewing a closure 41 across the width 21 of first and second pieces 36. As closure means 77 generally spans across width 21, compartments 40 are separate and distinct.

Cover 64 is formed from a tubular section of light weight fabric material having a length at least equal to the distance between junctures 26 and 27 though preferably, cover 64 is greater in length than the overall length of strap 10 as measured from the tips of ears 71 to joint 47. Cover 64 is preferably sewn into a tube 67 by sewing together the edges of a length of flat material approximately 10 inches in width and then inverting tube 67 such that the seam made at the edges is internally disposed. Thereafter, a length of elastic material slightly less than the circumference of strap 10 is sewn into each end of tube 67 previously made by stretching the elastic strap to the length of the inside circumference of tube 67 and sewing the stretched elastic strap to ends 65 of tube 67. When released, the elastic strap returns to its previous dimension, that is, about the circumference of strap 10 such that cover 64 is firmly held in place on strap 10. Cover 64 is preferably made from a 6.5 oz per square yard, stain resistant launderable cotton/polyester blend fabric of any desired color, texture, decoration or pattern. In one alternate embodiment, cover 64 may be made of a tubular woven fabric and thus has, no seam between the ends 65 thereof.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A carrying strap for carrying a skateboard upon the back of a person, said carrying strap comprising an elongated section of woven webbing material of a given width wherein at least one end of said elongated section of woven webbing is folded upon itself, said one end joined to said elongated section of woven webbing near said one end to form a closed tubular passage across said width adjacent said one end, said closed tubular passage having a portion of an expandable closed loop of material disposed therethrough, said elongated section of woven webbing having an inside surface and an outside surface, said inside surface and said outside surface comprising separate pieces of woven material, a first piece of said woven material having said inside surface on one side thereof and a second piece of woven material having said outside surface on one side thereof wherein a second side of said first piece of woven material is disposed in facing relationship to a second side of said second piece of woven material, said first piece of woven material affixed to said second piece of woven material along the marginal edges thereof establishing a space between said first piece of woven material and said second piece of woven material wherein said space is accessible through at least one opening in said second piece of woven material, said at least one said opening in said second piece of woven material having a closure means associated therewith.

2. A carrying strap as in claim 1 wherein said inside surface of said elongated section of woven webbing has a padding associated therewith.

3. A carrying strap as in claim 2 wherein said inside surface has said padding affixed thereto.

4. A carrying strap as in claim 1 wherein said space has a padding disposed therein.

5. A carrying strap as in claim 1 wherein said space is accessible through at least one opening in said first piece of woven material.

6. A strap as in claim 5 wherein said at least one said opening in said first piece of woven material has a closure means associated therewith.

7. A carrying strap as in claim 1 wherein said space is accessible through at least the top marginal end thereof.

8. A strap as in claim 7 wherein said top marginal end has a closure means associated therewith.

9. A carrying strap as in claim 1 wherein said outside surface has identifying information disposed thereon.

10. A strap as in claim 1 wherein said expandable closed loop of material in said closed tubular passage across said width adjacent one said end, is openable to a dimension at least equal to the width of said skateboard plus the height of a front wheel truck mounted on an underside of said skateboard, said closed loop of material retracting to a closed condition around said skateboard between said front wheel truck and said rear wheel truck substantially adjacent said front wheel truck thereby firmly holding said skateboard to said strap.

11. A strap as in claim 10 wherein said elongated section of woven webbing material has a closed tubular passage adjacent an end opposite said one end, said tubular passage having a second expandable closed loop of material in said closed tubular of said opposite end, said second expandable closed loop of material openable to a dimension at least equal to the width of said skateboard, said closed loop of material retracting to a closed condition around said skateboard aft of said rear wheel truck thereby firmly holding said skateboard to said strap and against the body adjacent the waist of the person carrying said skateboard.

12. A carrying strap as in claim 1 wherein said closure means is selected from the group comprising buttons, zippers, snaps, hook & loop fasteners mutually engaging tongue & grooves, bendable mating springs or combinations thereof.

13. A carrying strap for carrying a skateboard upon the back of a person, said carrying strap comprising an elongated section of woven webbing material of a given width having a top end and a bottom end, said top and said bottom ends having an end of said elongated section of woven webbing folded upon itself and joined to said elongated section of woven webbing near said top and said bottom ends to form a closed tubular passage across said width adjacent said top and said bottom ends, said closed tubular passage in said top and said bottom ends having a portion of a closed loop of expandable material disposed therethrough, said closed loop of expandable material having an axis through the opening therein, said axis generally perpendicular to the plane of said elongated section of woven webbing, wherein said closed loop on said top end is openable to a dimension at least equal to the width of said skateboard plus the height of a front wheel truck mounted on an underside of said skateboard and wherein said closed loop on said bottom end is openable to a dimension at least equal to the width of said skateboard.

14. A strap as in claim 13 wherein said closed loop on said top end closes around said skateboard between said front wheel truck and said rear wheel truck substantially adjacent said front wheel truck thereby firmly holding said skateboard to said strap.

15. A strap as in claim 13 wherein said closed loop on said bottom end closes around said skateboard aft of said rear wheel truck thereby firmly holding said skateboard to said strap and against the body adjacent the waist of the person carrying said skateboard.

* * * * *